US005778680A

United States Patent [19]

Wardle

[11] Patent Number: 5,778,680

[45] Date of Patent: Jul. 14, 1998

[54] APPARATUS FOR STORING A MULTI-COMPONENT CRYOGENIC MIXTURE WITHIN A CONTAINER

[75] Inventor: David G. Wardle, Bridgewater, N.J.

[73] Assignee: The BOC Group, Inc., New Providence, N.J.

[21] Appl. No.: 862,807

[22] Filed: May 23, 1997

[51] Int. Cl.[6] ..... F17C 3/10

[52] U.S. Cl. ..... 62/48.2; 62/49.2

[58] Field of Search ..... 62/48.2, 49.2

[56] References Cited

U.S. PATENT DOCUMENTS

| | | | |
|---|---|---|---|
| 2,984,988 | 5/1961 | Berger et al. | 62/49.2 |
| 3,303,660 | 2/1967 | Berg | 62/48.2 |
| 4,249,387 | 2/1981 | Crowley | 62/48.2 |
| 5,177,974 | 1/1993 | Uren et al. | 62/49.2 |

*Primary Examiner*—Ronald C. Capossela
*Attorney, Agent, or Firm*—David M. Rosenblum; Salvatore P. Pace

[57] ABSTRACT

An apparatus is provided for storing a multi-component cryogenic mixture as a liquid. The multi-component cryogenic mixture of interest contains at least first and second components. The first component is more volatile than the second component and the second component has a bubble point temperature atmosphere pressure, lower than that of the first component at an above atmosphere pressure. A container is provided in the apparatus for storing the cryogenic mixture. An inevitable heat leakage causes a cryogenic mixture to vaporize so that the vapor phase of the mixture is enriched in the first component and the liquid phase in the mixture is enriched in the second component. A conduit communicates between locations of the container situated above and below the head space region of the container so that vapor phase stream flows into the reservoir, opened to the atmosphere is provided in communication with the container such that a liquid phase stream, made up of the liquid phase flows into the reservoir and develops an ever increasing second component concentration. As such, the liquid phase of the mixture is able to condense the vapor phase of the mixture within the conduit. The resulting liquid will fall back into the container under influence of gravity to stabilize the concentration of the first and second components within the container.

4 Claims, 1 Drawing Sheet

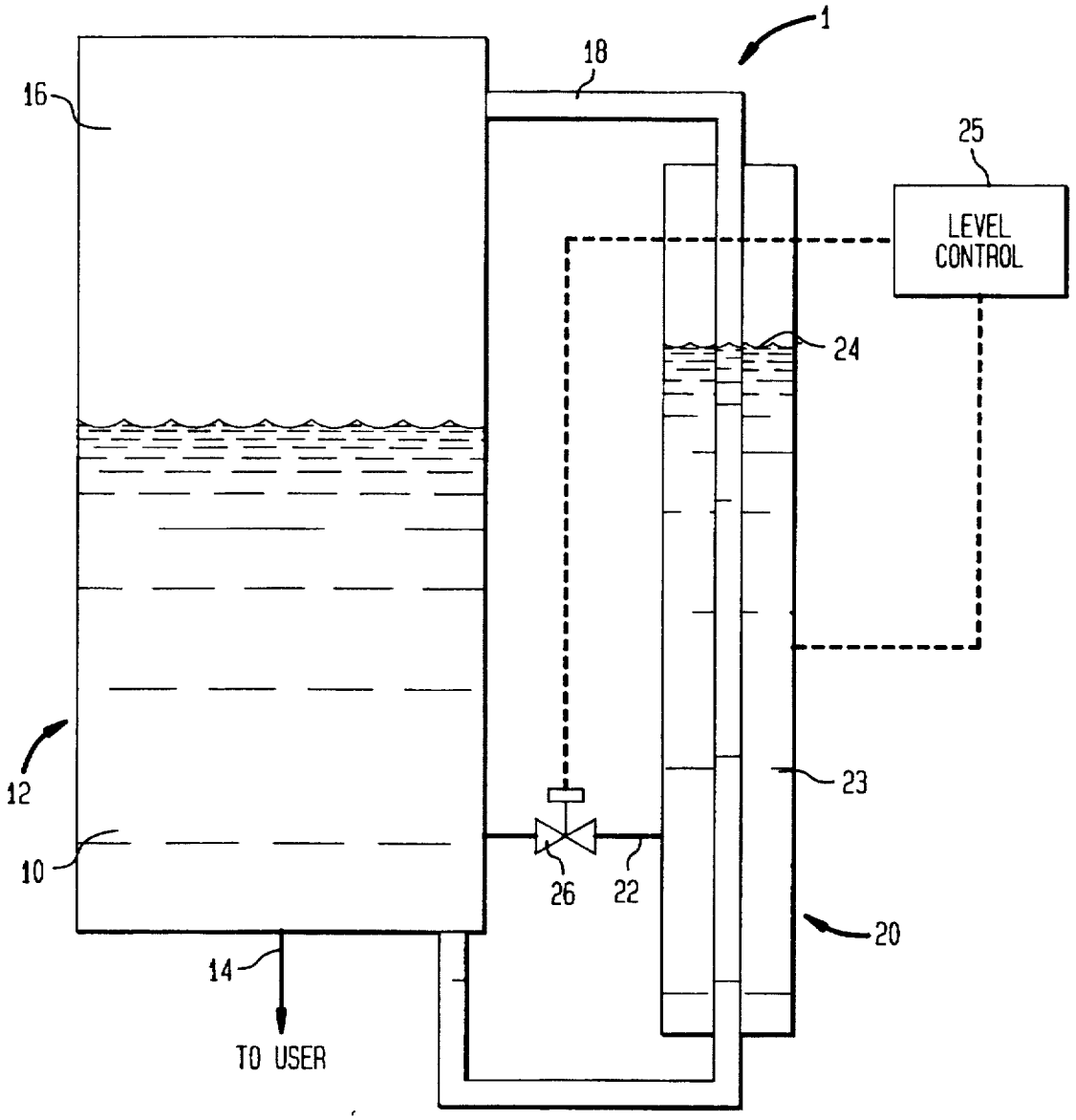
1
18
16
25
LEVEL CONTROL
24
12
23
10
26
22
20
14
TO USER

APPARATUS FOR STORING A MULTI-COMPONENT CRYOGENIC MIXTURE WITHIN A CONTAINER

BACKGROUND OF THE INVENTION

The present invention relates to an apparatus for storing a multi-component cryogenic mixture within a container. More particularly, the present invention relates to such an apparatus in which a reservoir open to the atmosphere is connected to the container to receive a liquid phase of the mixture and a conduit, in heat transfer contact with the reservoir, leads from a head space region of the container for condensing head space vapor against vaporizing the liquid phase of the mixture.

As has been recognized in the prior art, a multi-component cryogenic mixture stored within a container will suffer a change in component concentration over a period of time. The reason for such change is rooted in the fact that the components of the cryogenic mixture have different volatilities. If the multi-component cryogenic mixture is introduced into the container in a liquid form, inevitable heat leakage into the container will cause vaporization of the liquid. The more volatile components of the liquid to concentrate within a vapor phase located within a head space region of the container and the liquid phase will necessarily become more concentrated in the less volatile components.

This problem is commonly encountered in the storage of liquid air or synthetic breathable mixtures that contain oxygen and nitrogen. When one attempts to store such mixtures, a liquid phase of the mixture develops an ever increasing concentration of oxygen due to vaporization of the more volatile nitrogen. In order to prevent such enrichment, the prior art has provided apparatus such as illustrated in U.S. Pat. No. 5,571,231 in which an external condensation tank is connected to the head space region of a storage container. The condensation tank has a built-in heat exchanger which is connected to a bottom region of the storage container. The head space vapor is condensed within the external condensation tank by a liquid phase stream passing through the heat exchanger prior to being vented from the apparatus. A pressure building circuit is provided to drive the liquid back into the container. U.S. Pat. No. 3,260,060 discloses a cryogenic dewar in which liquid is vented through a heat exchanger located within a head space region of the dewar. As the pressure within the dewar increases, liquid passing through the heat exchanger condenses the vapor to stabilize the concentration of the liquid.

The problem with the cryogenic dewar illustrated in U.S. Pat. No. 3,260,060 is that it involves manufacturing dewars, storage containers, and the like, with heat exchangers in the head space region. Thus, the teachings of this patent cannot easily be applied as a retrofit to existing cryogenic dewars. While U.S. Pat. No. 5,571,231 solves the retrofit problem through the use of an external condensation tank which can simply be attached to the storage container, such retrofit involves the use of separately manufactured components such as the condensation tank used in condensing the head space vapor.

As will be discussed, the present invention provides an apparatus for storing a multi-component cryogenic mixture that can be applied to solve the retrofit problem in a manner that is far simpler than prior art techniques.

SUMMARY OF THE INVENTION

The present invention provides an apparatus for storing a multi-component cryogenic mixture as a liquid. The multi-component cryogenic mixture contains at least first and second components. The first component is more volatile than the second component and the second component has a bubble point temperature, at atmospheric pressure, lower than that of the first component at an above atmospheric pressure. An example of such a mixture would be liquid air or a liquid mixture comprising nitrogen and oxygen in which liquid oxygen is the second component and nitrogen is the first component.

The apparatus comprises a container for storing the cryogenic mixture. The cryogenic mixture vaporizes through heat leakage into the container such that a vapor phase of the mixture, enriched in the first component, is formed in the head space region of the container and at above the atmospheric pressure. A liquid phase of the mixture, enriched in the second component is formed below the head space region of the container. A conduit communicates between locations of the container above and below the head space region of the container such that a vapor phase stream composed of the vapor phase of the mixture flows into the conduit. A reservoir open to the atmosphere and a communication with a container is provided such that a liquid phase stream, made up of the liquid phase, flows into the reservoir and develops an ever increasing second component concentration. The reservoir is a heat transfer relationship with the conduit to condense the vapor phase stream. The reservoir is configured to develop a level of the liquid phase stream relative to the liquid such that the condensate formed from the condensation of the vapor phase stream develops a sufficient head to reenter the liquid phase of the mixture within the container.

The result of such reentry is to stabilize first and second component concentrations within the liquid phase of the mixture since it is the liquid phase that is vented under pressure and the liquid phase is continually being enriched with the vapor phase of the mixture which is in itself enriched with the first component.

The foregoing invention can be easily effectuated by a concentric arrangement of pipes in which one pipe serves as a conduit and the other serves as an open reservoir. In such manner, the subject invention can be practically realized with off-the-shelf items and not specially manufactured elements.

BRIEF DESCRIPTION OF THE DRAWINGS

While the specification concludes with claims distinctly pointing out the subject matter that the applicant regards as his invention, it is believed that the invention will be better understood when taken in connection with accompanying in which the sole figure is an apparatus designed in accordance with the present invention.

DETAILED DESCRIPTION

With reference to the figure, an apparatus 1 as illustrated for storing a multi-component cryogenic mixture as a liquid 10 within a container 12. Liquid 10 is dispensed from container 12 through an outlet line 14 thereof. The liquid to be stored within container 12 could be liquefied air or a mixture comprising liquid oxygen and liquid nitrogen to form a synthetic breathable mixture.

Heat leakage into container 12 produces a vapor phase of the mixture within a head space region 16 of container 12. The vapor phase of the mixture is enriched with the more volatile components, for instance nitrogen. The pressure within container 12 is above atmospheric pressure due to such vaporization.

A conduit 18 communicates between head space region 16 and below head space region 16, for instance, at the bottom of container 12. As a result, a vapor phase stream composed of the vapor phase of the mixture flows into conduit 18.

Conduit 18 can simply be a pipe. A reservoir 20, which at the top is open to the atmosphere, is provided in the heat transfer relationship with conduit 18. Reservoir 20 which is simply made up of a larger pipe than conduit 18 surrounds a section of conduit 18 to provide such heat transfer relationship. Reservoir 20 is in communication with container 12 such that a liquid phase stream, made up of the liquid phase flows into reservoir 20 through a conduit 22. Since reservoir 20 is open to the atmosphere, the liquid contained within reservoir 20 (designated by reference numeral 23), has a concentration which tends towards the less volatile components of the multi-component mixture to be stored. Although not illustrated, container 12, conduit 18 and reservoir 20 and conduit 22 would be encased in insulation in a manner known in the art.

In case of mixtures which comprise oxygen and nitrogen, the major less volatile component is oxygen. At atmospheric pressure, the bubble point temperature of the liquid oxygen is less than the bubble point of the nitrogen at elevated or above atmospheric pressures that will eventually develop within container 16. As a result, the vapor phase of the multi-component mixture (in the main nitrogen) within conduit 18 will condense and the level of liquid (designated by reference numeral 24) within conduit 18 will increase. Nitrogen as a liquid is less dense than a synthetic air mixture or liquid air. Thus, liquid 24 within conduit 18 will condense until a sufficient head is reached so that the liquid flows back into container 12 under the influence of gravity.

It is possible to design the foregoing apparatus 1 for steady state operation and without any control system. However, environmental changes necessitate a level control over the amount of liquid contained within reservoir 20. This can be effected in a known manner by for instance point level, capacitance or pressure transducers which generate the signal referable to the level of liquid 23 within reservoir 20 and transmit such signal to a level controller 25 which can be an analog or digital device such as a programmable logic emptier. An output signal is thus developed which can act on a remotely actuated valve 26 to allow liquid 23 to enter reservoir 20 when the level falls below a predetermined value.

While the present invention has been described with referenced to a preferred embodiment, as will occur to those skilled in the art, numerous changes, additions and omissions may be made without departing from the spirit and scope of the present invention.

I claim:

1. An apparatus for storing a multi-component cryogenic mixture as a liquid, said multi-component cryogenic mixture containing at least first and second components, the first component being more volatile than the second component, the second component having a bubble point temperature, at atmospheric pressure, lower than that of said first component at an above atmospheric pressure, said apparatus comprising:

a container for storing said cryogenic mixture, said cryogenic mixture vaporizing through heat leakage into said container such that a vapor phase of said mixture, enriched in said first component, is formed in a head space region of said container, at said above atmospheric pressure, and a liquid phase of said mixture, enriched in said second component, is formed below said head space region of said container;

a conduit communicating between locations of said container above at and below said head space region of said container such that a vapor phase stream composed of the vapor phase of the mixture flows into said conduit; and a reservoir open to the atmosphere and in communication with said container such that a liquid phase stream, made up of said liquid phase, flows into said reservoir and develops an ever increasing second component concentration, said reservoir in a heat transfer relationship with said conduit to condense said vapor phase stream and said reservoir configured to develop a level of said liquid phase stream relative to said liquid phase such that condensate formed from condensation of said vapor phase stream develops a sufficient head to re-enter said liquid phase of said mixture within said container, thereby to stabilize first and second component concentration within said liquid phase of said mixture.

2. The apparatus of claim 1, further comprising:

an actuable control valve interposed between said reservoir and said container;

a level detector generating a detection signal referable to height of said liquid phase stream within said reservoir; and a controller responsive to said detection signal, connected to said control valve, and having means for actuating said control valve so that said height of said liquid phase stream is maintained at said level.

3. The apparatus of claim 1, wherein said reservoir surrounds a section of said conduit.

4. The apparatus of claim 2, wherein said reservoir surrounds a section of said conduit.

* * * * *